US009163515B2

(12) United States Patent
Steiger et al.

(10) Patent No.: US 9,163,515 B2
(45) Date of Patent: Oct. 20, 2015

(54) GAS TURBINE ARRANGEMENT AND METHOD FOR OPERATING A GAS TURBINE ARRANGEMENT

(75) Inventors: Ulrich Robert Steiger, Baden-Dättwil (CH); Sascha Justl, Zürich (CH)

(73) Assignee: ALSTOM TECHNOLOGY LTD, Baden (CH)

( * ) Notice: Subject to any disclaimer, the term of this patent is extended or adjusted under 35 U.S.C. 154(b) by 533 days.

(21) Appl. No.: 13/294,974

(22) Filed: Nov. 11, 2011

(65) Prior Publication Data

US 2012/0121377 A1 May 17, 2012

(30) Foreign Application Priority Data

Nov. 15, 2010 (CH) ..... 1914/10

(51) Int. Cl.

| | |
|---|---|
| ***F01D 5/18*** | (2006.01) |
| ***F01D 9/06*** | (2006.01) |
| ***F01D 5/08*** | (2006.01) |

(52) U.S. Cl.

CPC ..... *F01D 5/081* (2013.01); *F01D 5/082* (2013.01); *F01D 5/18* (2013.01); *F01D 9/06* (2013.01); *F05D 2240/129* (2013.01); *F05D 2260/201* (2013.01); *F05D 2260/601* (2013.01); *F05D 2260/97* (2013.01)

(58) Field of Classification Search

CPC ..... F01D 5/081; F01D 5/082; F01D 5/18; F01D 5/187; F01D 9/06; F05D 2260/201

USPC ..... 415/1, 115–16, 173.7, 174.4, 174.5, 415/115–116; 416/1, 95, 96 R, 96 A, 97 R

See application file for complete search history.

(56) References Cited

U.S. PATENT DOCUMENTS

| | | | | |
|---|---|---|---|---|
| 3,251,601 | A | | 5/1966 | Harvey |
| 3,549,270 | A | | 12/1970 | Petrie et al. |
| 4,265,590 | A | * | 5/1981 | Davies ..... 415/110 |
| 4,348,157 | A | | 9/1982 | Campbell et al. |
| 5,211,533 | A | | 5/1993 | Walker et al. |

(Continued)

FOREIGN PATENT DOCUMENTS

| | | | |
|---|---|---|---|
| DE | 1221497 | * | 7/1966 |
| EP | 1911937 A2 | * | 4/2008 |
| GB | 1476237 A | | 6/1977 |

(Continued)

*Primary Examiner* — Christopher Verdier

(74) *Attorney, Agent, or Firm* — Buchanan Ingersoll & Rooney PC

(57) ABSTRACT

A gas turbine arrangement and a method of operating are provided. The turbine includes an annulus, axially delimited between a rotor unit, and at least one stationary component. Cooling medium outlet openings, lead into the annulus, from the stationary component. The cooling medium flows into cooling medium inlet openings, in the rotor unit in a flow direction, which propagates through the annulus. At least one inner cavity, radially to the annulus, is delimited by the rotor unit and by the stationary component. The inner cavity is pressurized with a purging gas, and is fluidically connected to the annulus. The stationary component and the rotor unit include a constriction by which the inner cavity is separated from the radially outer annulus and via which the inner cavity is fluidically connected to the radially outer annulus. Flow guides, fastened on the stationary component on one side, project into the constriction.

14 Claims, 1 Drawing Sheet

(56) References Cited

U.S. PATENT DOCUMENTS

| | | | | |
|---|---|---|---|---|
| 2003/0167775 | A1 | 9/2003 | Soechting et al. | |
| 2004/0265118 | A1 | 12/2004 | Naik et al. | |
| 2005/0217277 | A1* | 10/2005 | Alvanos et al. | 60/782 |
| 2006/0269398 | A1 | 11/2006 | Marini et al. | |
| 2006/0269399 | A1* | 11/2006 | Girgis et al. | 415/115 |

FOREIGN PATENT DOCUMENTS

| | | | |
|---|---|---|---|
| GB | 2081392 | A1 | 2/1982 |
| GB | 2251040 | A1 | 6/1992 |

* cited by examiner

A – A

B – B

A – A

GAS TURBINE ARRANGEMENT AND METHOD FOR OPERATING A GAS TURBINE ARRANGEMENT

RELATED APPLICATION

The present application hereby claims priority under 35 U.S.C. Section 119 to Swiss Patent application number 01914/10, filed Nov. 15, 2010, the entire contents of which are hereby incorporated by reference.

FIELD OF INVENTION

The invention relates to the field of gas turbines, specifically, a gas turbine arrangement having an annulus which is axially delimited between a rotor unit, which is rotatable around a rotor axis, and at least one stationary component, and into which lead a multiplicity of cooling medium outlet openings from the at least one stationary component, from which openings a cooling medium flow, mostly in the form of cooling air, can be discharged in each case into the annulus. Located inside the rotor unit, in the flow direction of the cooling medium flow which propagates through the annulus from the cooling medium outlet openings, are cooling medium inlet openings into which finds its way at least some of the cooling medium flow which is directed through cooling medium lines, connected to the cooling medium inlet openings inside the rotor unit, onto thermally loaded regions of the rotor unit or onto components which are associated with the rotor unit.

BACKGROUND

A generic-type gas turbine arrangement is shown in DE 1221497 and U.S. Pat. No. 4,348,157, in which to cool the rotor blades, which are attached on the rotor unit, cooling air is used, which is fed via cooling passages which extend inside stationary components of the gas turbine arrangement and, via correspondingly arranged cooling passage openings, impinges upon the rotor unit. On the rotor side, provision is also made for corresponding cooling air inlet openings into which at least some of the supplied cooling air flows. The transfer of the cooling air from the stationary components to the rotating rotor unit is carried out inside an annulus which on one side, axially to the rotor axis, is delimited by the rotor unit and by the stationary component. Adjoining radially on the inside is a further, inner annulus into which purging gas is introduced in order to protect components of the rotor unit close to the rotor shaft against friction-induced overheating. For operation-related reasons, the purging gas which directly envelops the rotor shaft is very intensely swirled and forms a heavily pronounced swirled flow inside the cavity. The pressure ratios in the respective regions of the gas turbine decrease as radial shaft spacing increases, i.e. the purging gas which is on the rotor shaft side is under a higher pressure compared with the pressure ratios inside the annulus, which in turn lie above the operating pressure ratios inside the hot gas passage.

A radially oriented leakage flow occurs and is directed from the inner side, i.e. from the cavity close to the rotor shaft, through the radially inner annular sealing arrangement into the cavity and from this through the radially outer annular sealing arrangement into the main gas passage. It becomes apparent in this case that the leakage flow which radially penetrates into the annulus is able to significantly disturb the cooling air flow which is provided there for the purpose of cooling the rotor unit and the flow direction of which is predominantly axially oriented, as a result of which the portion of cooling air flow which finds its way into the cooling medium inlet openings is reduced and the cooling effect and also the efficiency of the entire gas turbine arrangement which is associated therewith deteriorate considerably.

The cooling air only enters the turbine blade at the required pressure if it impinges with the designated flow direction. The more uniform the inflow is for entry into the blade root, the more favorable and more efficient is the arrangement.

In the previously cited printed publication, to this end it is proposed to provide a deflection device on the rotor side between the radially opposite annular sealing arrangements, which forces the leakage flow into radially extending passages so that a flow path for the leakage flow between the radially inner and outer annular sealing arrangements past the respective cooling passage openings is created.

Apart from the previously described feature of annular sealing arrangements not being fully gastight, as a result of which a leakage flow develops, it is necessary to ensure a controlled exchange of the purging gas which is introduced between the rotating and stationary installation components. For maintaining a determined exchange of purging gas, it is necessary to discharge this at least proportionately via corresponding connecting passages or leakage-conditioned annular sealing arrangements radially outwards, mostly into the operating passage of the respective rotating turbomachine. In the case of a turbine stage, therefore, the purging gas finds its way through corresponding intermediate gaps into the hot gas passage in which the purging gas intermixes with the hot gases.

In addition to the already explained flow disturbance which the leakage-conditioned purging gas flow exerts upon the cooling air flow which passes largely axially through the annulus, the high swirl portion of the purging gas flow, moreover, contributes towards the static pressure inside the annulus being reduced, as a result of which the cooling effect of the cooling air flow in the region of the rotor unit and of the rotor blades which are associated therewith is again weakened.

SUMMARY

The present disclosure is directed to a gas turbine arrangement including an annulus, which is axially delimited between a rotor unit, rotatable around a rotor axis, and at least one stationary component. A plurality of cooling medium outlet openings, from which a cooling medium flow can be discharged, lead into the annulus, from the at least one stationary component. The cooling medium flows, at least proportionately, into cooling medium inlet openings, provided in the rotor unit in a flow direction of the cooling medium flow, which propagates through the annulus. The arrangement also includes, radially to the annulus, at least one inner cavity which is delimited by the rotor unit and by the at least one stationary component. The at least one inner cavity is pressurized with a purging gas, and is fluidically connected to the annulus. The at least one stationary component and the rotor unit include a constriction by which the at least one inner cavity is separated from the radially outer annulus and via which the at least one inner cavity is fluidically connected to the radially outer annulus. Flow guides, which are fastened on the at least one stationary component on one side, project into the constriction.

In another aspect, the present disclosure is directed to a method for operating the above gas turbine arrangement. The method includes passing, as a result of a pressure drop which exists between the at least one cavity and the annulus, the pressurized purging gas, in the form of a purging gas flow, through a constriction by which the at least one inner cavity is separated from the radially outer annulus and via which the at least one inner cavity is fluidically connected to the radially outer annulus. The method also includes applying a generally swirl-free flow characteristic to the purging gas flow when passing through the constriction.

BRIEF DESCRIPTION OF THE DRAWINGS

The invention is subsequently exemplarily described based on exemplary embodiments with reference to the drawings, without limitation of the general inventive idea. In the drawings.

DETAILED DESCRIPTION OF THE PREFERRED EMBODIMENTS

Introduction to the Embodiments

Figure 1A:
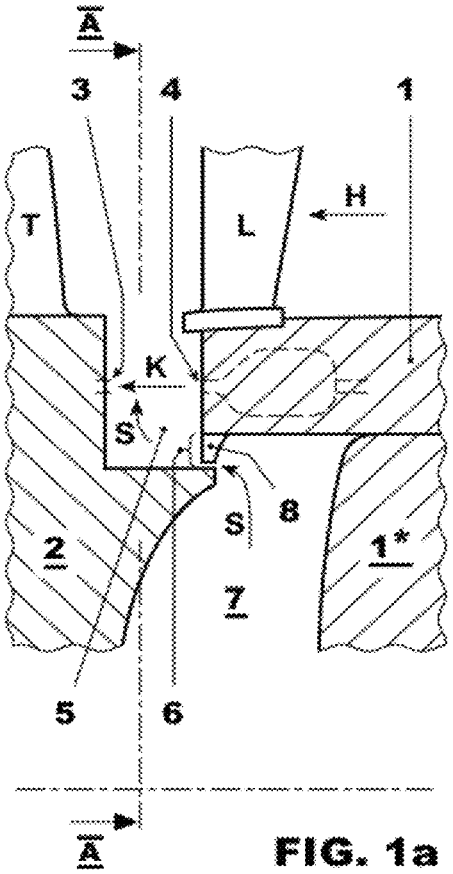
FIG. 1*a* shows a longitudinal section through a schematized representation of the constriction which is delimited between a rotor unit and stationary component.

It is an object of the present invention to further develop a gas turbine arrangement and a method for operating a gas turbine arrangement—having an annulus which is axially delimited between a rotor unit, which is rotatable around a rotor axis, and at least one stationary component, into the annulus, from the at least one stationary component, lead a multiplicity of cooling medium outlet openings from which a cooling medium flow, preferably in the form of a cooling air flow, can be discharged into the annulus, the cooling medium flow at least proportionately finds its way into cooling medium inlet openings which are provided in the rotor unit in the flow direction of the cooling medium flow which propagates through the annulus, and also having, radially to the annulus, at least one inner cavity which is delimited by the rotor unit and by at least one stationary component, is pressurized with a purging gas, and is fluidically connected to the annulus—in such a way that a purging gas flow, which for system-related reasons finds its way into the annulus, has a disturbing influence which is as insignificantly small as possible upon the cooling medium flow which passes largely axially through the annulus. In particular, it is necessary to adopt measures by means of which the pressure ratios inside the annulus remain as uninfluenced as possible, despite a purging gas flow entering the annulus.

The above object is achieved by the disclosed gas turbine arrangement. A method according to the solution for operating a gas turbine arrangement is also disclosed.

According to the solution, a gas turbine arrangement having at least one stationary component and a rotor unit, includes a constriction by which at least one cavity is separated from a radially outer annulus and via which the at least one cavity is fluidically connected to the radially outer annulus, and flow guides, which are fastened on the at least one stationary component on one side, project into the constriction.

The design and arrangement of the flow guides along the at least one stationary component are undertaken in this case in such a way that the pressurized purging gas, on account of a pressure drop which exists between the at least one cavity and the annulus, passes through the constriction in the direction of the annulus in the form of a purging gas flow so that a largely swirl-free flow characteristic is applied to the purging gas flow when passing through the constriction, i.e. the flow swirl portion which is inherent to the purging gas flow after passing through the constriction into the annulus is appreciably less than the initial flow swirl of the purging gas before passing through the constriction, i.e. inside the at least one cavity. It is an aim to reduce the swirl which is imposed upon the purging gas flow in the cavity by rotating the rotor unit in the rotational direction of said rotor unit. In one embodiment, purging gas flow is admitted from the constriction into the annulus without swirl around the rotor axis. It is also desirable to achieve a smoothing, which is as complete as possible, of the intensely swirled purging gas flow on the cavity side when passing through the constriction, i.e. ideally the purging gas flow should pass through the annulus in a swirl-free manner, i.e. in the form of a laminar flow. A purging gas flow with minimal swirl, or free of swirl, which passes through the annulus, on the one hand has a low disturbance potential for the largely axially oriented cooling air flow, on the other hand the static pressure inside the annulus is not impaired in the long term as a result of this.

In order to ensure a controlled outflow of the purging gas which is present in the at least one cavity close to the rotor axis, the at least one cavity indirectly or directly adjoins the annulus radially to the rotor axis towards the outside via a gap-like constriction. On account of the largely axially symmetrical design of the rotor unit and also of the stationary components of the gas turbine arrangement which are arranged directly adjacent to the rotor unit, the gap-like constriction between the rotor unit and the at least one stationary component includes a constriction which is formed like an annular gap, by means of which a purging gas flow is formed on account of a radial pressure drop which exists between the at least one cavity and the annulus.

A multiplicity of individual flow guides are attached in the circumferential direction, on the side of the stationary component which delimits the constriction on one side, and extend into the constriction without coming into contact with the rotor unit in the process. The flow guides which are attached in the circumferential direction, preferably with equidistant spacing, delimit in pairs a throughflow section which determines the flow path for the purging gas, which discharges from the at least one cavity, in the direction of the radially outer annulus. When arranging and designing the individual flow guides it is necessary to take into consideration the maxim that the intensely swirled purging gas inside the cavity, after passing through the throughflow sections which are delimited by the flow guides, furthermore passes radially outwards through the annulus as far as possible in the form of a swirled-reduced gas flow, preferably a swirl-free, purging gas flow. In a preferred embodiment, the flow guides are formed in the style of guide vanes which have a vane profile which is curved in the axial direction. A vane profile which is curved in the axial direction, at its end located upstream (leading edge), forms an entry angle between profile and rotor axis which points in the rotational direction of the rotor, and at its end located downstream (trailing edge) forms an emergence angle between profile and rotor axis which is smaller than the entry angle. The emergence angle is typically zero. The angle can even point against the circumferential direction of the rotor rotation in order to create a slight counter-swirl. This, for example, can be advantageous in order to maintain an altogether swirl-free flow after mixing with the portion of the purging air which does not flow through between the vane profiles but flows through in the gap between profile end and rotor unit.

Naturally, flow guides which deviate from this are also conceivable, for example in the form of rectilinearly designed flow-stable ribs which, similar to the previous explanations, are fixedly connected to the at least one stationary component and distributed with equidistant spacing in relation to each other in the circumferential direction in each case, and, terminating freely on one side, project into the constriction.

DETAILED DESCRIPTION

FIG. 1*a* shows a longitudinal section through a portion of a gas turbine installation, which schematically shows a portion of the rotor unit 2 which is rotatably arranged around the rotor axis A. It may be assumed that the rotor unit 2, which is illustrated in FIG. 1*a*, corresponds to a rotor disk which is associated with the first turbine rotor blade row and on the circumferential edge of which the turbine rotor blades T are arranged.

Axially opposite the rotor unit 2, is a stationary component 1, which has a surface facing the rotor unit 2 that includes a multiplicity of individual cooling medium outlet openings 4 from which cooling air K, generally in the form of a suitably predetermined swirled flow, is discharged into the annulus 5 which is delimited on both sides between the rotor unit 2 and the stationary component 1. A cooling air reservoir, which is supplied with cooling air via a cooling air system, is formed inside the stationary component 1. A corresponding nozzle arrangement inside the respective cooling air outlet openings 4 ensures a flow swirl along the cooling air flow K which flows into the annulus 5.

Depending upon the construction of the cooling medium inlet opening, it can be advantageous to introduce the cooling air K into the annulus 5 in a swirl-free manner. In this case, the respective cooling air outlet openings 4 are arranged so that the cooling air is introduced swirl-free, i.e. axially, into the annulus 5.

Preferably, the swirl of the cooling air K and purging air S is the same during their intermixing in order to minimize the mixing losses.

Radially towards the outside, that is to say towards the hot gas passage which conducts the hot gases H, the depicted annulus 5 is closed off at least partially by means of platform ends of a row of stator blades L.

Some of the cooling air flow K which is introduced into the annulus 5 finds its way via cooling medium inlet openings 3, provided on the rotor side, into the interior of the rotor unit 2 in which corresponding cooling lines (not shown) are provided which convey the received cooling air K preferably into the regions of the turbine rotor blades T. For effective cooling of the rotor unit 2 and especially of the turbine rotor blades T, it is necessary not to impair, as much as possible, the pressure ratios and flow ratios inside the annulus 5 as to insure that cooling air K in sufficient quantity from the stationary component 1 can find its way into the rotor unit 2 via the annulus 5.

On the other hand, the rotor unit 2 and the stationary component 1 and also possibly further stationary components 1* include a cavity 7 close to the rotor axis, which is filled with purging gas in order to protect radially inner rotor regions and also adjacent stationary components against overheating.

For an exchange of the purging gas which is introduced in the cavity 7, some of the purging gas in the form of a purging gas flow S customarily passes through a constriction 6, which is delimited on both sides between the rotor unit 2 and the stationary component 1, into the annulus 5 which the purging gas flow S passes through radially outwards essentially transversely to the cooling air flow K and is finally admixed with the hot gases H in the operating passage of the gas turbine arrangement. Depending upon the selection of the pressure ratios between annulus and hot gas passage, a slight penetration of hot gas into the annulus can also occur. In an exemplary embodiment, the constriction 6 is formed at least in sections in an annular manner between the stationary component 1 and the rotor unit 2.

In order to prevent the purging gas flow S—which on account of the rotational movements of the rotor unit 2 in the region of the cavity 7 is intensely swirled and therefore would both reduce the pressure ratios in the annulus 5 and would also significantly disturb the cooling air flow K—from passing radially outwards through the annulus 5, flow guides 8 are attached on the stationary component 1 in the region of the constriction 6 and, terminating freely on one side, project into the constriction 6 in each case. The individual flow guides 8 are designed in the form of small guide vanes and project from the stationary component 1 on one side into the constriction 6 without making contact with the rotor unit 2 in the process.

Depending upon the selection of the narrow gap 6', the height of which should ideally be zero, brushing of the flow guides 8 against the rotor unit 2 may occur during transient operation of the gas turbine. In order to allow such brushing, provision can be made on the free end of the flow guides 8 for an abrasive edge, a cutting edge or equivalent means. Furthermore, the use of honeycombs or an abradable coating on the corresponding brushing surface of the rotor unit 2 is possible.

Figure 1B:
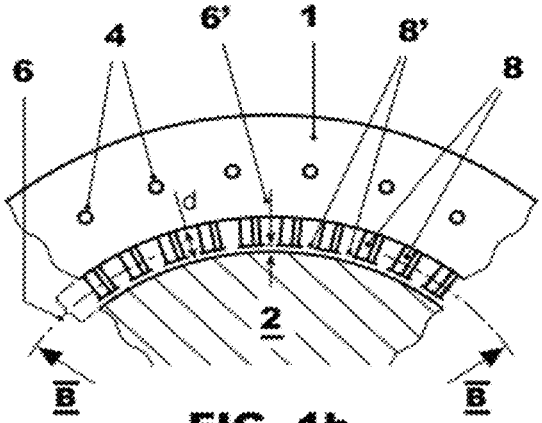
FIG. 1*b* shows a schematized arrangement of flow guides on the stationary component in an axial view.

Shown in FIG. 1*b* is a representation, in an axial direction of view, of the constriction 6 (section A-A of FIG. 1*a*) which is delimited between the stationary component 1 and the rotor unit 2. Shown are cooling medium outlet openings 4 from which cooling air from the stationary component 1 is discharged into the annulus. Flow guides 8, which project into the constriction 6 and therefore divide the constriction 6 into a multiplicity of throughflow sections D which are delimited between the flow guides, are fixedly connected in each case to the stationary component 1 on one side. The individual flow guides 8, which are preferably designed in the form of small guide vanes, on their free end which faces the rotor unit 2 have a shroud 8' in each case, which together with the rotor unit 2 includes a narrow gap 6'. The gap width of the narrow gap 6' should be less than or equal to half the gap width d of the constriction 6, i.e. less than or equal to half the largest distance between the at least one stationary component 1 and the rotor unit 2 in a region of the constriction 6. Preferably, however, the narrow gap 6' should be of a minimal setting in such a way that as far as possible no flow portions of the purging gas flow S can find their way through between the shrouds 8' of the flow guides 8 and the rotor unit 2. In an exemplary embodiment, the flow guides 8 are variably adjustable around at least one spatial axis.

In order to smooth out the intensely swirled purging gas flow S—in the state in which it discharges directly from the cavity 7 in the direction of the annulus 5—with regard to its amount of swirl, the throughflow sections D between adjacently arranged flow guides 8 in each case serve as forced flow paths, along which the purging gas flow S is smoothed out, homogenized or evened out, so that downstream to the flow guides 8 a largely swirl-free purging gas flow, which propagates in a uniform flow direction, flows into the annulus 5.

Figure 1C:
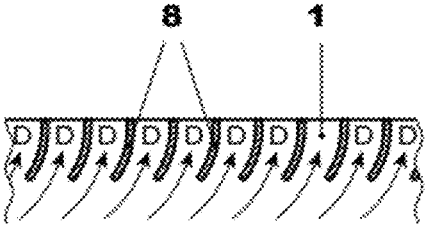
FIG. 1*c* shows flow guides connected to the stationary component, in a radial, outwardly oriented view.

FIG. 1*c* shows a radially outwardly oriented view of the profile of the respective flow guides 8 (section B-B). The individual flow guides 8, on account of their profile being of a design which extends in a curved manner in the axial direction, include throughflow sections D which similarly extend in a curved manner and which are exposed to throughflow by the purging gas flow.

The shape and design of the flow guides can be individually adapted according to the aerodynamic purging gas characteristic inside the cavity 7 and are not limited to the design of profile shapes which are of a guide vane-like form.

Also, consideration could be given to varying the arrangement or the setting of the individual flow guides relative to the purging gas flow S which flows through the throughflow sections D in order to be able to undertake adjustments if necessary in dependence upon different last stages of the gas turbine installation in which variably intensely pronounced vortices can form within the purging gas in the cavity 7.

Figure 1D:
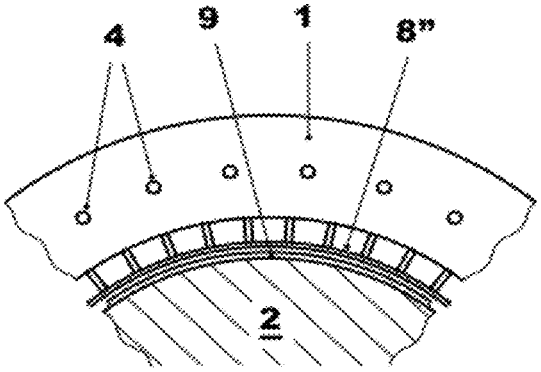
FIG. 1*d* shows a schematized arrangement of flow guides on the stationary component in axial view.

Shown in FIG. 1*d* is a representation of a second embodiment with axial direction of view of the constriction 6 (section A-A). This differs compared with the embodiment shown in FIG. 1*b* as a result of a continuously closed shroud 8". In order to minimize the leakage through the narrow gap 6', a seal 9 is attached on the shroud 8". This can be at least one sealing strip of a labyrinth seal or a brush seal, for example. The seal can correspondingly also be attached on the rotor unit 2.

In one embodiment, the flow guides 8 with the closed shroud 8" are assembled as segments. For example, a multiplicity of flow guides 8 are provided as a circle segment with closed shroud 8".

LIST OF DESIGNATIONS

1 Stationary component
1* Stationary component
2 Rotor unit
3 Cooling medium inlet openings
4 Cooling medium outlet openings
5 Annulus
6 Constriction
6' Narrow gap
7 Cavity
8 Flow guides
8' Shroud
8" Closed shroud
9 Seal
A Rotor axis
D Throughflow passage
H Hot gases
K Cooling medium flow
L Stator blade
S Purging gas flow
d Gap width of the constriction

What is claimed is:

1. A gas turbine arrangement comprising:

an annulus, which is axially delimited between a rotor unit, rotatable around a rotor axis, and at least one stationary component;

a plurality of cooling medium outlet openings, from which a cooling medium flow can be discharged, lead into the annulus, from the at least one stationary component, the cooling medium flows proportionately into cooling medium inlet openings, provided in the rotor unit in a flow direction of the cooling medium flow, that propagates through the annulus, radially to the annulus, at least one inner cavity which is delimited by the rotor unit and by the at least one stationary component, the at least one inner cavity is pressurized with a purging gas, and is fluidically connected to the annulus, wherein the at least one stationary component and the rotor unit comprise a constriction by which the at least one inner cavity is separated from the radially outer annulus and via which the at least one inner cavity is fluidically connected to the radially outer annulus, and wherein flow guides, which are fastened on the at least one stationary component on one side and extend from the radially innermost portion of the at least one stationary component, project into the constriction and guide a purging gas flow, the flow guides have a profile of a design which extends in a curved manner in the axial direction, and the flow guides have throughflow sections which extend in a curved manner from an axial inlet to an axial outlet.

2. The gas turbine arrangement as claimed in claim 1, wherein the constriction is formed in sections in an annular manner between the at least one stationary component and the rotor unit, and a plurality of the flow guides, distributed in the circumferential direction, are provided along the annular constriction so that two adjacent flow guides delimit a throughflow section.

3. The gas turbine arrangement as claimed in claim 1 wherein the flow guides are formed in such a way that the purging gas flow, which enters the annulus through the constriction from the at least one cavity, obtains a flow characteristic which is generated by the flow guides.

4. The gas turbine arrangement as claimed in claim 1, wherein the flow guides are formed as guide vanes.

5. The gas turbine arrangement as claimed in claim 4, wherein the guide vanes have a blade profile which is curved in the axial direction.

6. The gas turbine arrangement as claimed in claim 1, wherein the flow guides each have a free end which faces the rotor unit and together with the rotor unit include a narrow gap, the gap width of which is less than or equal to half a gap width of the constriction, and the gap width of the narrow gap is less than or equal to half the largest distance between the at least one stationary component and the rotor unit in a region of the constriction.

7. The gas turbine arrangement as claimed in claim 6, wherein the flow guides are in a form of guide vanes, and each flow guide has a shroud attached on a free end of the flow guide.

8. The gas turbine arrangement as claimed in claim 1, wherein the rotor unit is a rotor disk with turbine rotor blades attached on a circumferential edge thereof, and the at least one stationary component is a stationary component which is attached directly axially opposite the rotor unit, with a cooling air reservoir which is supplied with cooling air by a cooling air system and from which cooling air flows into the annulus via the cooling medium outlet openings.

9. The gas turbine arrangement as claimed in claim 1, wherein the flow guides are variably adjustable around at least one spatial axis.

10. The gas turbine arrangement as claimed in claim 1, wherein the flow guides are arranged so the purging gas flow that passes through the constriction in the direction of the annulus so that a largely swirl-free flow characteristic is applied to the purging gas flow when passing through the constriction.

11. The gas turbine arrangement as claimed in claim 1, wherein the throughflow sections extend axially from the at least one inner cavity to the radially outer annulus.

12. A method for operating a gas turbine arrangement having an annulus, which is axially delimited between a rotor unit, rotatable around a rotor axis, and at least one stationary component; a plurality of cooling medium outlet openings, from which a cooling medium flow can be discharged, lead into the annulus, from the at least one stationary component, the cooling medium flows proportionately into cooling medium inlet openings, provided in the rotor unit in a flow direction of the cooling medium flow, that propagates through the annulus, the arrangement also comprising, radially to the annulus, at least one inner cavity which is delimited by the rotor unit and by the at least one stationary component, the at least one inner cavity is pressurized with a purging gas, and is fluidically connected to the annulus, a constriction which separates the at least one inner cavity from the radially outer annulus and via which the at least one inner cavity is fluidically connected to the radially outer annulus, and flow guides, which are fastened on the at least one stationary component on one side and extend from the radially innermost portion of the at least one stationary component, project into the constriction and guide a purging gas flow, the flow guides have a profile of a design which extends in a curved manner in the axial direction, and the flow guides have throughflow sections which extend in a curved manner, the method comprising:

passing, as a result of a pressure drop between the at least one cavity and the annulus, the pressurized purging gas, in the form of a purging gas flow, through the constriction by which the at least one inner cavity is separated from the radially outer annulus and via which the at least one inner cavity is fluidically connected to the radially outer annulus; and applying a generally swirl-free flow characteristic to the purging gas flow when passing through the constriction.

13. The method as claimed in claim 12, wherein the applying of the generally swirl-free flow characteristic is carried out by the flow guides which are provided inside the constriction in such a way that a flow swirl which is inherent to the purging gas flow after passing through the constriction into the annulus is less than an initial flow swirl of the purging gas flow before passing through the constriction from inside the at least one inner cavity.

14. A gas turbine arrangement comprising:

an annulus, which is axially delimited between a rotor unit, rotatable around a rotor axis, and at least one stationary component;

a plurality of cooling medium outlet openings, from which a cooling medium flow can be discharged, lead into the annulus, from the at least one stationary component, the cooling medium flows proportionately into cooling medium inlet openings, provided in the rotor unit in a flow direction of the cooling medium flow, that propagates through the annulus, radially to the annulus, at least one inner cavity which is delimited by the rotor unit and by the at least one stationary component, the at least one inner cavity is pressurized with a purging gas, and is fluidically connected to the annulus, wherein the at least one stationary component and the rotor unit comprise a constriction by which the at least one inner cavity is separated from the radially outer annulus and via which the at least one inner cavity is fluidically connected to the radially outer annulus, wherein flow guides, which are fastened on the at least one stationary component on one side and extend from the radially innermost portion of the at least one stationary component, project into the constriction and guide a purging gas flow, and wherein the flow guides are variably adjustable around at least one spatial axis.

* * * * *